United States Patent [19]

Konomi et al.

[11] 3,968,780

[45] July 13, 1976

[54] FUEL SYSTEM FOR MULTICYLINDER ENGINES

[75] Inventors: Toshiaki Konomi; Jyoji Nurita, both of Susono, Japan

[73] Assignee: Toyota Jidosha Kogyo Kabushiki Kaisha, Aichi, Japan

[22] Filed: July 18, 1974

[21] Appl. No.: 489,549

[30] Foreign Application Priority Data

Jan. 17, 1974 Japan ..... 49-7529

[52] U.S. Cl. ..... 123/141; 48/180 R

[51] Int. Cl.[2] ..... F02M 29/00

[58] Field of Search ..... 123/141, 119 E; 48/180 R, 180 M; 261/78 R

[56] References Cited

UNITED STATES PATENTS

| | | | |
|---|---|---|---|
| 1,526,963 | 2/1925 | Chandler | 48/180 M |
| 1,632,196 | 6/1927 | Rhoads | 123/141 |
| 2,498,190 | 2/1950 | Weeks | 48/180 R |
| 2,769,698 | 11/1956 | Paul | 48/180 R |
| 2,822,253 | 2/1958 | Caddock | 123/141 X |
| 2,847,289 | 8/1958 | Buhrmeister | 48/180 R |
| 3,393,984 | 7/1968 | Wisman | 123/141 X |

FOREIGN PATENTS OR APPLICATIONS

| | | | |
|---|---|---|---|
| 741,462 | 2/1933 | France | 123/141 |

*Primary Examiner*—Charles J. Myhre
*Assistant Examiner*—Ira S. Lazarus
*Attorney, Agent, or Firm*—Toren, McGeady and Stanger

[57] ABSTRACT

The fuel-air mixture distribution in a multi-cylinder engine is provided by a hollow cylinder disposed immediately downstream of and in coaxial relation with a carburetor barrel and a deflector is attached to the dischage or downstream end or opening of the hollow cylinder so that the fuel-air mixture flow may be deflected. The deflector is inclined downwardly toward the cylinders. In another embodiment, a hollow cylinder having a deflector attached at its discharge end, is also attached to the discharge opening of the primary carburetor barrel. A slanting opening is formed through the side wall of the hollow cylinder.

5 Claims, 38 Drawing Figures

FIG. 17A
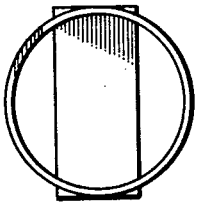
FIG. 18A
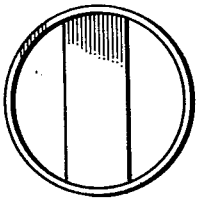
FIG. 19A
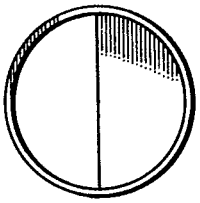
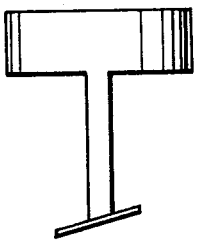
FIG. 17B
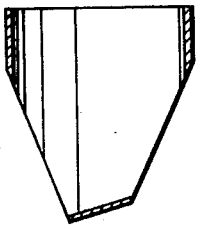
FIG. 18B
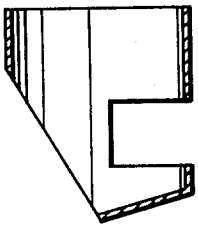
FIG. 19B
FIG. 20A
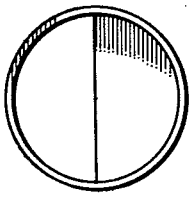
FIG. 21A
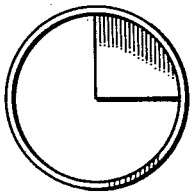
FIG. 22A
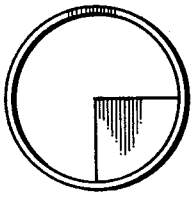
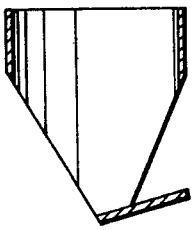
FIG. 20B
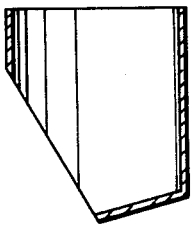
FIG. 21B
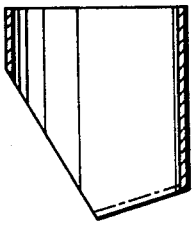
FIG. 22B FIG. 23A
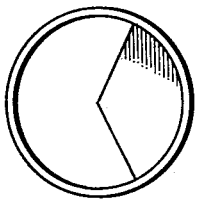
FIG. 24A
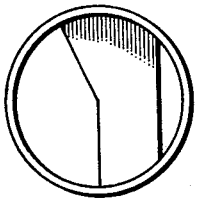
FIG. 25A
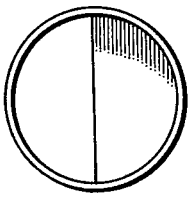
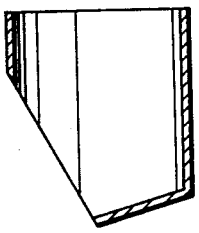
FIG. 23B
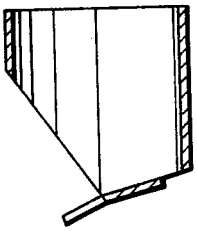
FIG. 24B
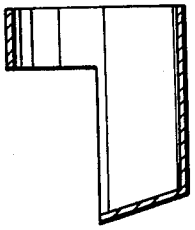
FIG. 25B
FIG. 26A
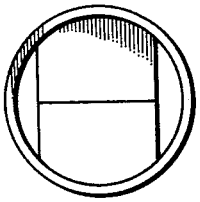
FIG. 27A
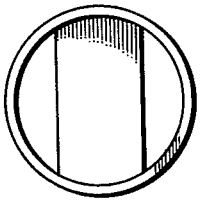
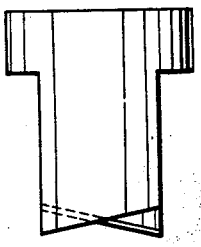
FIG. 26B
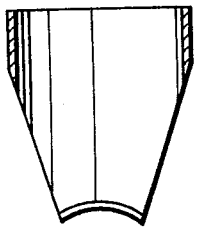
FIG. 27B

FUEL SYSTEM FOR MULTICYLINDER ENGINES

BACKGROUND OF THE INVENTION

1. Field of the Invention

The present invention relates generally to a multicylinder internal combustion engine and, more particularly, to an improvement for the equal distribution of the fuel-air mixture to the cylinders of a multi-cylinder engine.

2. Description of the Prior Art

Various methods for equally distributing the fuel-air mixture between the cylinders of a multi-cylinder engine have been devised and demonstrated, but none of them is satisfactory in practice. In order to improve the equal distribution of the fuel-air mixture in a multi-cylinder engine under full load, a method has been proposed for modifying the configurations of a multi-branched intake manifold, heating the riser of the intake manifold or reducing the diameter of the intake ports, but such method is also unsatisfactory in practice. Another method has been proposed for disposing a device including a rotary blade assembly, a fixed blade assembly and a pipe with wire gauze immediately below a carburetor for improving the atomization of the liquid fuel, but this method cannot ensure the equal and uniform distribution of the fuel-air mixture.

The distribution of the fuel-air mixture between the cylinders under full engine load is dependent upon the direction of the fuel-air mixture flow from the carburetor to the intake manifold, and the direction of the fuel-air mixture flow changes depending upon the engine speed. Especially in the case of a multi-barrel carburetor, the direction of the fuel-air mixture flow is dependent upon the operations of the individual carburetor barrels. Therefore, satisfactory equal and uniform distribution of the fuel-air mixture may be attained at a certain engine speed range, but not over the whole range of the engine speed. At some engine speeds, the fuel-air mixture distribution becomes even worse.

However, when the tendency of the fuel-air mixture to flow in one direction after it has been discharged from the carburetor into the intake manifold is suppressed and then the fuel-air mixture is forced to flow in a predetermined direction, the equal and uniform distribution of the fuel-air mixture may be improved over the whole engine speed range.

SUMMARY OF THE INVENTION

In view of the experience of the prior art, the present invention has as its primary object to provide a multi-cylinder engine in which a hollow cylinder is disposed immediately downstream of and in coaxial relation with the discharge end of a carburetor and a deflector is attached to the discharge end of the hollow cylinder so that the deflector may be inclined downwardly toward the cylinders. In one embodiment of the present invention, the hollow cylinder with the deflector of the type described, is attached to a primary barrel of a double-barrel carburetor and another cylinder having a slanting opening formed through the side wall thereof is disposed in the down-stream of a throttle valve in a secondary barrel.

BRIEF DESCRIPTION OF THE DRAWING

FIGS. 17–27B are schematic views of some modifications thereof.

DESCRIPTION OF THE PREFERRED EMBODIMENTS

Figure 1:
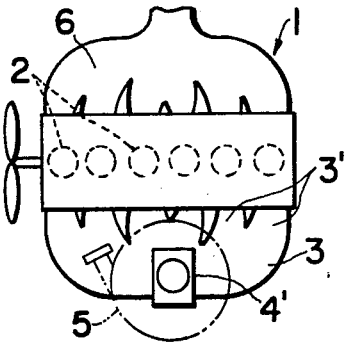
FIG. 1 is a schematic top view of a multi-cylinder engine to which is applied the present invention.
Figure 2:
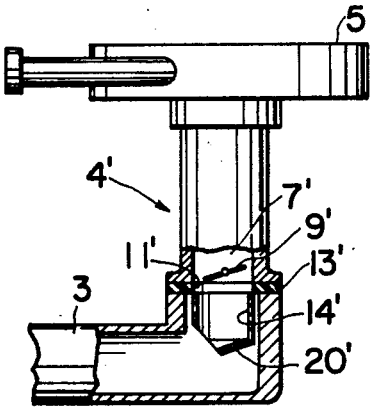
FIG. 2 is a view illustrating a first embodiment of the present invention.

In FIGS. 1 and 2, a first embodiment of the present invention applied to a six-cylinder engine is illustrated. Each of the six cylinders 2 of an engine body 1 is in communication with a branch 3′ of a multi-branched intake manifold 3 which in turn communicates through a connection pipe with a carburetor 4′ and an air cleaner 5. Therefore, the fuel-air mixture is fed into the cylinders 2 from the carburetor 4′. After the combustion stroke, the exhaust gases are discharged through a multibranched exhaust manifold into the surrounding atmosphere.

Within a barrel 7′ of the carburetor 4′ is disposed a throttle valve 9′. An insulator 13′ provided with an opening 11′ is interposed between the carburetor 4′ and the intake manifold 3 so that the intake manifold 3 may be in communication with the carburetor barrel 7′ through this opening 11′. A hollow cylinder 14′ is disposed in the downstream of the opening 11′ of the insulator 13′ and is parallel or coaxial with the barrel 7′, and at the opening on the side downstream of the cylinder 14′ is disposed a segmental deflector 20′ which closes about a quarter of the opening area. The deflector 20′ is disposed on the side remote from the cylinders 2 and is inclined downwardly toward the cylinders 2. Therefore, the fuel-air mixture flow flowing out of the cylinder 14′ from the carburetor 4′ is deflected substantially at a right angle by the deflector so that the uniform distribution of the fuel-air mixture in all the branches 3′ may be ensured.

Figure 3:
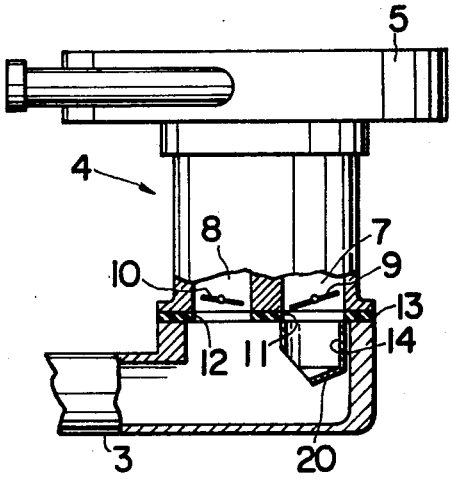
FIG. 3 is a side view with a part removed of a second embodiment of the present invention in which the invention is applied to a double-barrel carburetor of a multi-cylinder engine.
Figure 4:
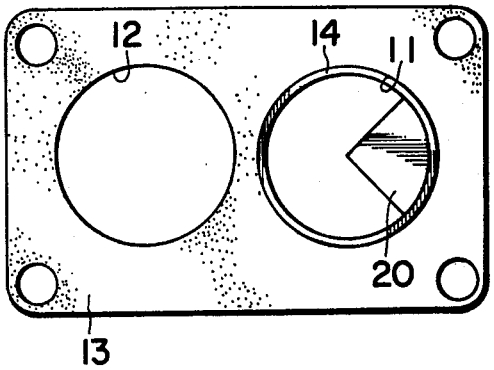
FIG. 4 is a top view of an insulator and a hollow cylinder attached thereto used in the second embodiment shown in FIG. 3.
Figure 5:
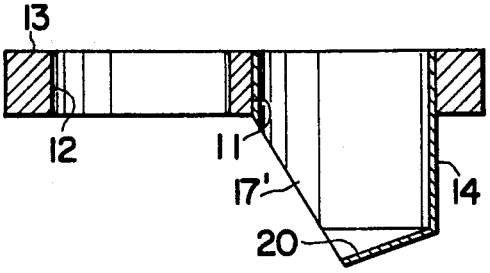
FIG. 5 is a sectional view thereof.
Figure 6:
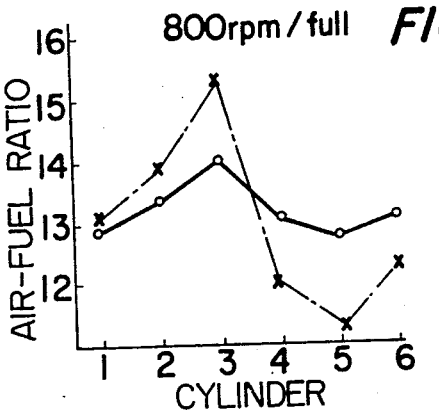
FIGS. 6, 7, 8, 9, 11, 12, 14 and 16 are graphs of the air-fuel ratios in the cylinders used for the explanation of the effects attained by the second embodiment.
Figure 7:
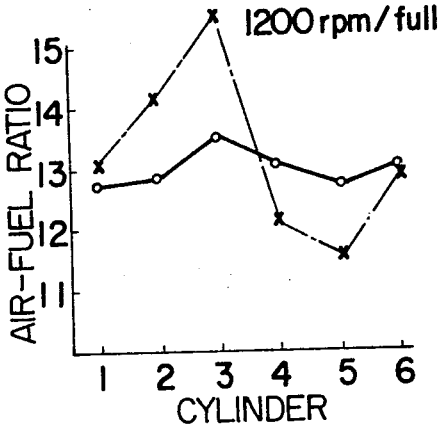
Figure 8:
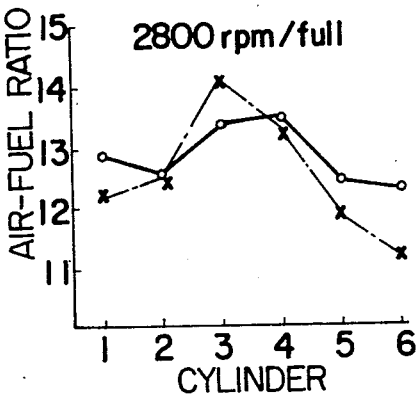
Figure 9:
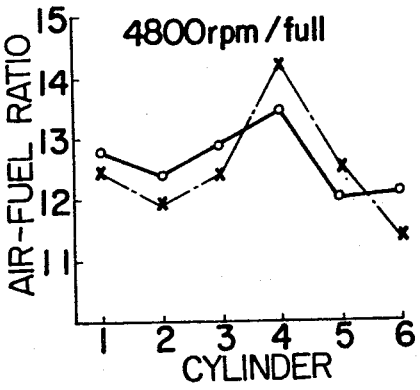

Next, the second embodiment in which the present invention is applied to a double-barrel carburetor will be described with reference to FIGS. 3, 4 and 5. The double-barrel carburetor 4 comprises primary and secondary barrels 7 and 8 in which are disposed throttle valves 9 and 10, respectively. The throttle valve 10 in the secondary barrel 8 is automatically opened by a mechanism (not shown) when the throttle valve 9 in the primary barrell 7 is opened in excess of a predetermined opening. Like the first embodiment, the insulator 13 provided with two openings 11 and 12 is interposed between the double-barrel carburetor 4 and the intake manifold 3 so that the fuel-air mixtures flow from the primary and secondary barrels 7 and 8 through the openings 11 and 12, respectively, as best shown in FIG. 3. The hollow cylinder 14 is disposed below the opening 11 on the side of the primary carburetor barrel 7 in parallel or coaxial relationship, and the segmental deflector 20 is disposed at the lower opening of the cylinder 14 in order to close about a quarter of the opening. The apex of the deflector 20 is positioned on a line connecting the centers of the openings 11 and 12 of the insulator 13 as best shown in FIG. 4. The deflector 20 is inclined downwardly toward the downstream of the secondary barrel 8. A slanted opening 17' is formed through the side wall of the cylinder 14, facing toward the downstream of the second barrel 8. The greater the opening area of the slanted opening 17', the less the intake resistance of the fuel-air mixture becomes.

The axial or vertical flow of the fuel-air mixture from the primary barrel 7 is deflected by the deflector 20 into a horizontal flow to be fed into the six cylinders 2 of the engine through the branches 3' of the intake manifold 3.

Next, referring to FIGS. 6, 7, 8 and 9, the distribution of the fuel-air mixture into the six cylinders 2 will be described based upon the data obtained from the experiments conducted by the inventors upon the second embodiment with the above construction. FIGS. 6–9 show the air-fuel ratios in the cylinders 2 at the speeds of 800, 1200, 2,800 and 4,800 rpm, respectively, under full load. The air-fuel ratios are plotted along the ordinates with the numbers of the six cylinders listed along the abscissa. The solid curves denote the air-fuel ratios attained by the present invention while the chain curves denote those of the engines not incorporating the cylinder 14 of the present invention.

Figure 10:
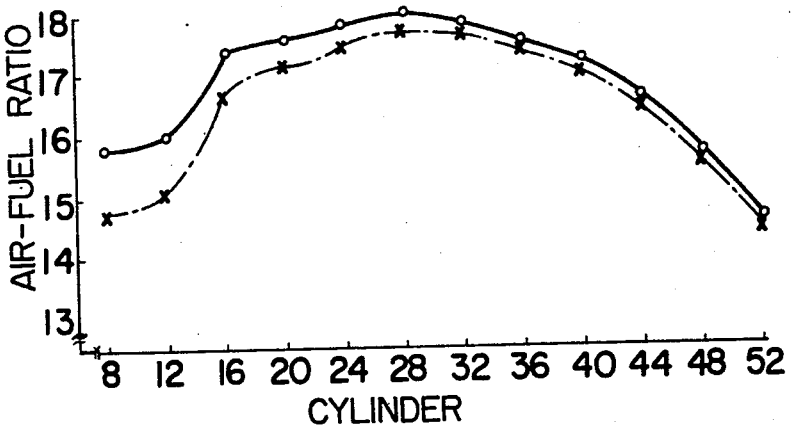
FIG. 10 is a graph of the power output used also for the explanation of the effects of the second embodiment.

It is seen from these graphs that the variation in air-fuel ratio is considerably reduced according to the present invention so that the fuel-air mixture may be more equally distributed. Therefore the power output is increased as shown in FIG. 10. It is seen that the power output is increased over the whole speed range. Especially at a lower speed, the power output is increased by about 1 kg. m, and the power output is also improved at a high speed because the deflector 20 is small in size and is inclined even though the intake resistance is increased.

Figure 11:
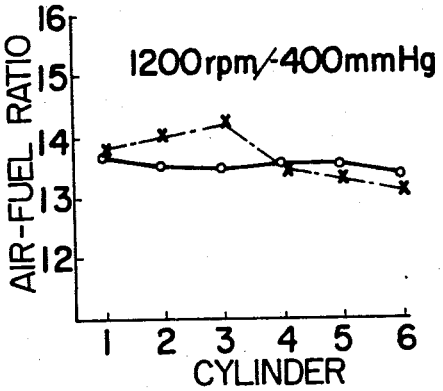
Figure 12:
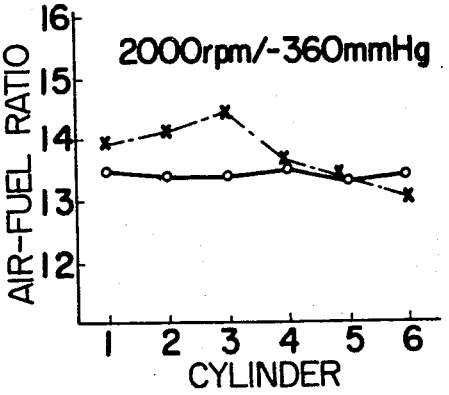

FIGS. 11 and 12 show the air-fuel ratios in the cylinders 2 under partial load at the speeds of 1,200 rpm with the intake manifold negative pressure of 400 mm Hg and 2,000 rpm with the intake manifold negative pressure of 360 mm Hg, respectively. It is seen that the fuel-air mixture is more equally distributed even under partial load.

Figure 13:
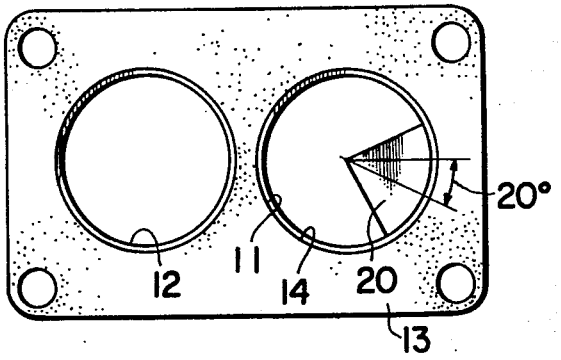
FIG. 13 is a top view of a third embodiment of the present invention.

In the second embodiment, the apex of the deflector 20 is positioned on the line interconnecting the centers of the openings 11 and 12 of the insulator 13, but it is to be understood that the same effects may be attained even when the deflector 20 is rotated through about 20° from the position shown in FIG. 4 as shown in FIG. 13.

Figure 15:
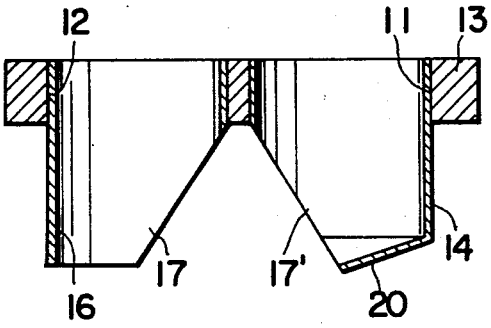
FIG. 15 is a sectional view thereof.

The third embodiment is substantially similar in construction to the second embodiment except that in addition to the cylinder 14 attached to the primary barrel 7 through the opening 11 of the insulator 13, another cylinder 16 is attached to the secondary carburetor barrel 8 through the opening 12 of the insulator 13 in parallel or coaxial relationship with the second barrel 8. A downwardly slanted opening 17 is also formed through the side wall of the cylinder 16 as best shown in FIG. 15, but no deflector is attached to the lower opening of the cylinder 16.

Figure 14:
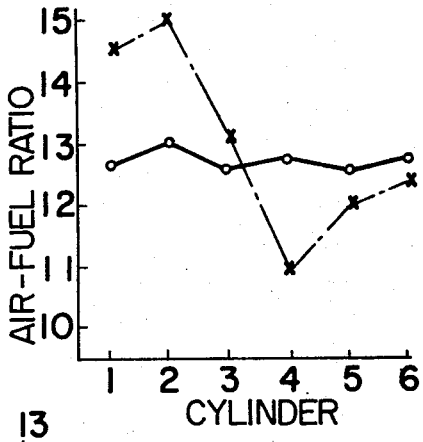
Figure 16:
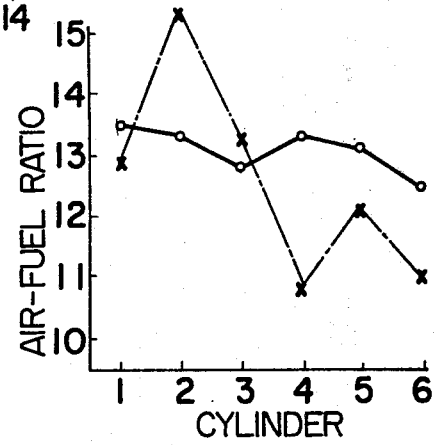

The distribution of the air-fuel mixture into the six cylinders according to the third embodiment is also shown in FIGS. 14 and 16. The solid curves denote the air-fuel ratios of the third embodiment while the chain curves, those of the prior art. It is seen from FIGS. 14 and 16 that the equal distribution of the fuel-air mixture is considerably improved over the second embodiment in which only one cylindner 14 is attached to the primary carburetor barrel 7.

The cylinder or cylinders attached to the primary carburetor barrel 7 or to both the primary and secondary carburetor barrels 7 and 8 and the deflector 20 may be modified in dimensions and configurations, and some of the modifications which are found to be very effective in the equal distribution of the fuel-air mixture and to exhibit less intake resistance from the extensive experiments conducted by the inventors will be described hereinafter with reference to FIGS. 17A–27B.

In general, the deflectors are inclined in such a way that the free edge, that is the portion of the deflector disposed in the downstream of the secondary barrel 8, is placed lower than the edge or portion remote from the secondary carburetor barrel 8 so that the resistance to the fuel-air mixture flow may be slightly reduced. In the modifications shown in FIGS. 17A–B, 18A–B, 19A–B, 20A–B, 24A–B, 26A–B and 27A–B, an opening is formed through the side wall remote from the downstream of the secondary barrel 8 of the cylinder so that the fuel-air mixture flowing from the double-barrel carburetor 4 perpendicular to the riser in the intake manifold 3 may be deflected in the same direction with that of the riser. In the modifications shown in FIGS. 4, 22A–B, 23A–B and 25A–B, only one opening is formed through the cylinder wall so that the fuel-air mixture is deflected only in one direction. Therefore the modifications shown in FIGS. 17A–B, 18A–B, 19A–B, 20A–B, 24A–B, 26A–B and 27A–B which deflect the fuel-air mixture into two directions have the advantage over the modifications shown in FIGS. 4, 22A–B, 23A–B and 25A–B that the intake resistance may be reduced.

In the modifications shown in FIGS. 26A–B and 27A–B, curved deflectors are used. That is, both edges of the deflector near and remote from the downstream of the secondary carburetor barrel 8 are lower than the center portion. This arrangement has a distinct advantage that the fuel may be prevented from being accumulated over the curved surface of the deflector so that the starting of the engine may be facilitated. That is, the curved deflector is used in order to prevent the delay in fuel feed in case of acceleration. Furthermore the fuel-air mixture is divided into two flows toward the riser which are symmetrical about the center line of the primary carburetor barrel so that the equal distribution of the fuel-air mixture may be further improved.

As described above, according to the present invention, the cylinder with the inclined deflector attached to the downstream opening of the cylinder is disposed downstream of the carburetor so that the fuel-air mixture may be deflected and be equally distributed among the cylinders. The deflector exhibits less resistance to the fuel-air mixture flow to the cylinders so that the reduction in power output may be prevented. Therefore, the power output may be increased over the whole range of the engine speed, the fuel consumption may be reduced, and the response may be improved. Moreover, due to the improvement of the equal distribution of the fuel-air mixture, there is no fear of misfiring even when the air-fuel ratio is low, and the pollutants such as CO and HC in the exhaust gases may be reduced. Furthermore, the vibrations of the engine may be reduced with the result of less noise. Moreover, the adjustments based upon the effects of the cylinder, such as the improvement of the engine cold starting may be possible. It is also possible to attach the cylinder only in the downstream of the secondary carburetor barrel instead of the primary barrel.

What is claimed is:

1. In a multicylinder engine comprising an intake manifold having branches in communication with the cylinders and an intake port, and a carburetor having an axially extending primary barrel and an axially extending secondary barrel each in communication with said intake port, the improvement comprising that said secondary barrel is adjacent to and located downstream from said primary barrel toward said intake port, a hollow cylinder coaxial with said primary barrel and attached thereto at the downstream end of said primary barrel, a deflector attached to said hollow cylinder near its downstream opening and extending across a portion of the downstream opening, said deflector positioned for reorienting axial flow through said at least one barrel toward said intake port, said deflector defining with said hollow cylinder two openings from the downstream end of said first hollow cylinder, whereby the fuel-air mixture may be equally distributed among the cylinders.

2. The improvement according to claim 1 further comprising an additional hollow cylinder attached to the downstream end of said secondary barrel.

3. The improvement according to claim 2 wherein each of said hollow cylinders has a slanted opening in its sidewall at its downstream end, each said slanted opening located in a plane extending obliquely of the axis of said hollow cylinder in which it is formed.

4. The improvement according to claim 1, wherein said deflector comprises a curved plate with said curved plate having a convex and a concave surface, and said convex surface directed into said cylinder.

5. An improvement, according to claim 1, wherein said deflector is located in a plane extending transversely of the axis of said primary barrel with the plane of said deflector oriented obliquely to the axis of said primary barrel and sloping downwardly in the direction toward said secondary barrel.

* * * * *